US011077544B2

(12) United States Patent
Reott

(10) Patent No.: US 11,077,544 B2
(45) Date of Patent: Aug. 3, 2021

(54) TOOL HANDLE AND METHODS OF USE

(71) Applicant: Jason Reott, Brunswick, GA (US)

(72) Inventor: Jason Reott, Brunswick, GA (US)

( * ) Notice: Subject to any disclaimer, the term of this patent is extended or adjusted under 35 U.S.C. 154(b) by 0 days.

(21) Appl. No.: 16/911,379

(22) Filed: Jun. 24, 2020

(65) Prior Publication Data

US 2020/0406445 A1 Dec. 31, 2020

Related U.S. Application Data

(60) Provisional application No. 62/866,567, filed on Jun. 25, 2019.

(51) Int. Cl.

| | |
|---|---|
| ***B25G 1/01*** | (2006.01) |
| ***B25G 1/02*** | (2006.01) |
| ***B25G 1/10*** | (2006.01) |
| ***B25G 1/04*** | (2006.01) |

(52) U.S. Cl.

CPC ..... *B25G 1/01* (2013.01); *B25G 1/02* (2013.01); *B25G 1/04* (2013.01); *B25G 1/102* (2013.01)

(58) Field of Classification Search

CPC . B25G 1/01; B25G 1/02; B25G 1/025; B25G 1/04; B25G 1/102

See application file for complete search history.

(56) References Cited

U.S. PATENT DOCUMENTS

| | | | | | |
|---|---|---|---|---|---|
| 483,477 | A * | 9/1892 | Ryan | B25G 3/02 | 294/57 |
| 531,882 | A * | 1/1895 | Stewart | B25G 1/01 | 30/340 |
| 843,590 | A * | 2/1907 | Dunn et al. | B25G 1/04 | 15/144.4 |
| 1,397,899 | A * | 11/1921 | Palmer | B25G 1/02 | 403/181 |
| 1,653,995 | A * | 12/1927 | English | B25G 1/02 | 81/8.1 |
| 1,977,180 | A * | 10/1934 | Forbes | A47L 13/24 | 403/100 |
| 2,980,457 | A * | 4/1961 | Page | B25G 1/02 | 15/245 |
| 5,348,360 | A * | 9/1994 | Mencarelli | B25G 1/01 | 16/421 |
| 5,384,930 | A * | 1/1995 | Uno | A46B 5/0062 | 116/212 |
| 6,371,465 | B1 * | 4/2002 | Willis | F16F 1/06 | 267/166 |
| 7,118,145 | B1 * | 10/2006 | Rosine | B25G 1/01 | 294/57 |
| D572,094 | S * | 7/2008 | Rosine | D8/10 | |

(Continued)

*Primary Examiner* — Jeffrey O'Brien

(74) *Attorney, Agent, or Firm* — Mathew L. Grell; Jeffrey C. Watson; Grell & Watson Patent Attorneys LLC

(57) ABSTRACT

A tool handle apparatus and methods of use, for slinging or casting contents therefrom, the tool includes a spade having a spade neck extending from a first spade end, a spade handle having a first handle end a midsection, and a second handle end, said first handle end connected to said spade neck, a spring having a first spring end and a second spring end, said first spring end affixed to said midsection and said second spring end connected to said second handle end, and a looped strap connected to said second handle end and, thus, functions to assist a user in slinging or casting contents therefrom.

21 Claims, 6 Drawing Sheets

(56) References Cited

U.S. PATENT DOCUMENTS

| | | | | |
|---|---|---|---|---|
| 7,581,771 | B2 * | 9/2009 | Rosine | A01B 1/02 294/54.5 |
| 8,966,703 | B1 * | 3/2015 | Thomas | B25G 1/01 15/236.01 |
| D727,696 | S * | 4/2015 | Clark | D8/10 |
| 9,050,717 | B2 * | 6/2015 | Mouch | B25G 3/26 |
| 9,073,198 | B1 * | 7/2015 | Menius | B25G 1/02 |
| 9,085,078 | B1 * | 7/2015 | Huang | A47L 13/58 |
| 9,198,337 | B2 * | 12/2015 | Walsh | B25D 1/16 |
| 10,913,144 | B1 * | 2/2021 | Whicker | B25G 3/26 |
| 2004/0123470 | A1 * | 7/2004 | Gray | A47L 13/022 30/169 |
| 2007/0163062 | A1 * | 7/2007 | McKay | A47L 25/005 15/104.002 |
| 2008/0256732 | A1 * | 10/2008 | Donatelli | B25G 1/02 15/144.1 |
| 2010/0064860 | A1 * | 3/2010 | Kozak | B25B 23/0028 81/177.6 |
| 2013/0167694 | A1 * | 7/2013 | Shih | B25G 1/04 81/489 |
| 2017/0239789 | A1 * | 8/2017 | Sian | B25G 1/04 |
| 2018/0133887 | A1 * | 5/2018 | Crookston | B25G 3/26 |
| 2019/0143187 | A1 * | 5/2019 | Lyons | A63B 60/08 15/144.3 |
| 2020/0122313 | A1 * | 4/2020 | Takada | B25G 1/04 |
| 2020/0338712 | A1 * | 10/2020 | Rastegar | B25G 1/04 |
| 2020/0391371 | A1 * | 12/2020 | Nelson | A01D 7/02 |
| 2021/0022327 | A1 * | 1/2021 | Barber | B25G 3/30 |

* cited by examiner

TOOL HANDLE AND METHODS OF USE

CROSS-REFERENCE TO RELATED APPLICATIONS

To the full extent permitted by law, the present United States Non-provisional Patent Application hereby claims priority to and the full benefit of, U.S. Provisional Application No. 62/866,567, filed on Jun. 25, 2019, entitled "Springed Tool Handle and Methods of Use", which is incorporated by reference herein in its entirety.

FIELD OF THE DISCLOSURE

The present disclosure is directed to a tool handle apparatus and methods of use thereof. More specifically, the present disclosure is directed to a biasing handle for a tool and methods of use.

BACKGROUND

Various approaches have been utilized to design a handle to a tool whether wood, metal, alloy, rigid plastic, fiberglass, or the like in an effort to balance both strength, weight, and vibration characteristics of the handle for the tool and the tools intended use. One disadvantage or drawback to these approaches is that a rigid handle is cumbersome when utilizing the tool to sling or cast contents therefrom the tool.

Therefore, it is readily apparent that there is a recognizable unmet need for a tool handle apparatus and methods of use that may be configured to address at least some aspects of the problems discussed above common to tools used to sling or cast contents therefrom.

SUMMARY

Briefly described, in an example embodiment, the present disclosure may overcome the above-mentioned disadvantages and may meet the recognized need for a tool handle apparatus and methods of use, for sling or casting contents therefrom, the tool includes a spade having a spade neck extending from a first spade end, a spade handle having a first handle end a midsection, and a second handle end, said first handle end connected to said spade neck, a spring having a first spring end and a second spring end, said first spring end affixed to said midsection and said second spring end connected to said second handle end, and a looped strap connected to said second handle end and, thus, functions to assist a user in slinging or casting contents therefrom.

Accordingly, in one aspect, the present disclosure makes it easier to discharge contents from a shovel.

Accordingly, in another aspect, the present disclosure may include a variety of biasing elements, including coil springs.

Accordingly, in another aspect, the present disclosure may integrate a biasing element with a variety of handled tools including but not limited to shovels, rake, broom, pitch fork, ax, hammer and other yard, garden or hand tools (generically spade and handle) and whips, and fishing poles.

Accordingly, in another aspect, the present disclosure may include any handle composition including but not limited to wood, bamboo, metal, alloy, rigid plastic, fiberglass, or the like.

In an exemplary embodiment of the tool handle apparatus for lifting and scattering content, said apparatus includes a work piece having a connector neck, a first elongated member having a first grip end and a second grip end, said first grip end connected thereto said connector neck, a coil spring having a first coil spring end and a second coil spring end, said first coil spring end connected thereto said second grip end, a second elongated member having a first spring extension end and a second spring extension end, said first spring extension end connected thereto said second coil spring end, and a handle, said handle connected thereto said second spring extension end.

In another exemplary embodiment of the tool handle apparatus method may include the steps of providing a providing a tool handle configured as a work piece having a connector neck, a first elongated member having a first grip end and a second grip end, said first grip end connected thereto said connector neck, a coil spring having a first coil spring end and a second coil spring end, said first coil spring end connected thereto said second grip end, a second elongated member having a first spring extension end and a second spring extension end, said first spring extension end connected thereto said second coil spring end, and a handle, said handle connected thereto said second spring extension end, gathering content on said work piece, lifting said first elongated member, bending said coil spring relative to said handle, and spreading the content by discharging the content from said work piece.

In an exemplary embodiment of the tool handle apparatus for fast casting a lure, said apparatus includes a handle, a first elongated pole member having a first handle section end and a second handle section end, said first handle section end connected thereto said handle, a coil spring having a first coil spring end and a second coil spring end, said first coil spring end connected thereto said second handle section end, a second elongated member having a first spring extension end and a second spring extension end, said first spring extension end connected thereto said second coil spring end, a reel connected to said first handle section end, said reel having a fishing line fed therethrough a plurality of pole loops positioned on said first elongated pole member and said second elongated member, said fishing line connected to a lure.

A feature of the present disclosure may include its ability to be utilized to sling or cast contents therefrom the tool due to the integration of a biasing element therein the handle.

A feature of the present disclosure may include its ability to catapult, sling, spread, or empty shovel, rake, broom, pitch fork, or other yard, garden or hand tools contents further.

A feature of the present disclosure may include its ability to swing an ax or hammer with accelerated whip and impact.

A feature of the present disclosure may include its ability to cast or whip a fishing pole with accelerated cast or whip to cast a lure a further distance.

These and other features of the tool handle apparatus and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present tool handle apparatus and methods of use will be better understood by reading the Detailed Description of the Preferred and Selected Alternate Embodiments with reference to the accompanying drawing Figures, in which like reference numerals denote similar structure and refer to like elements throughout, and in which.

Figure 1:
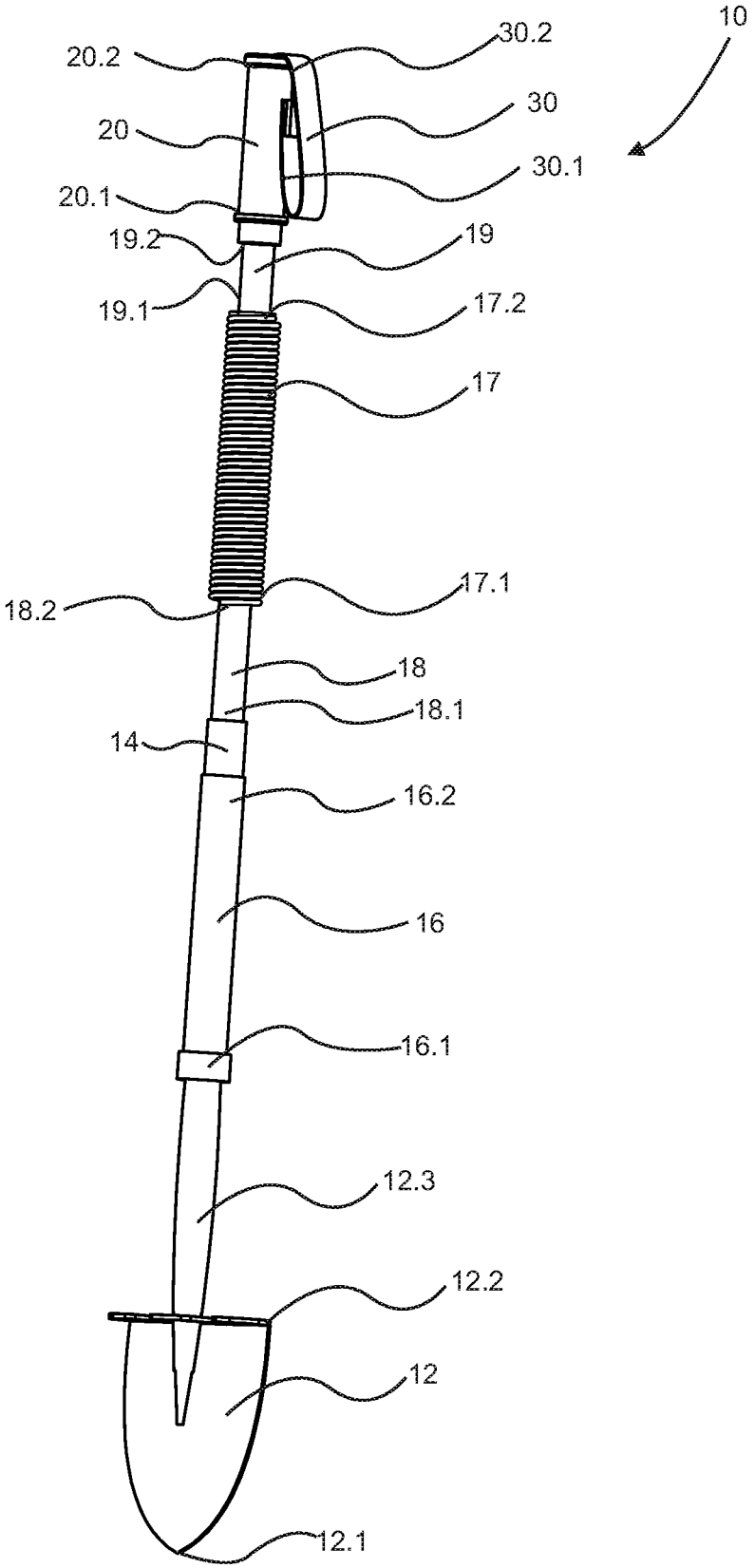
FIG. 1 is a perspective view of the tool handle apparatus according to select embodiments of the instant disclosure.
Figure 2:
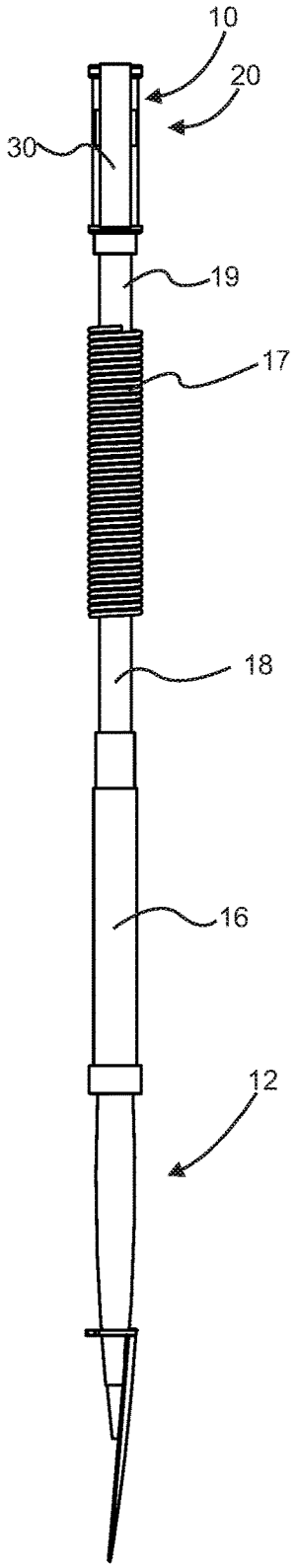
FIG. 2 is a side view of the tool handle apparatus according to select embodiments of the instant disclosure with spring bent.
Figure 3A:
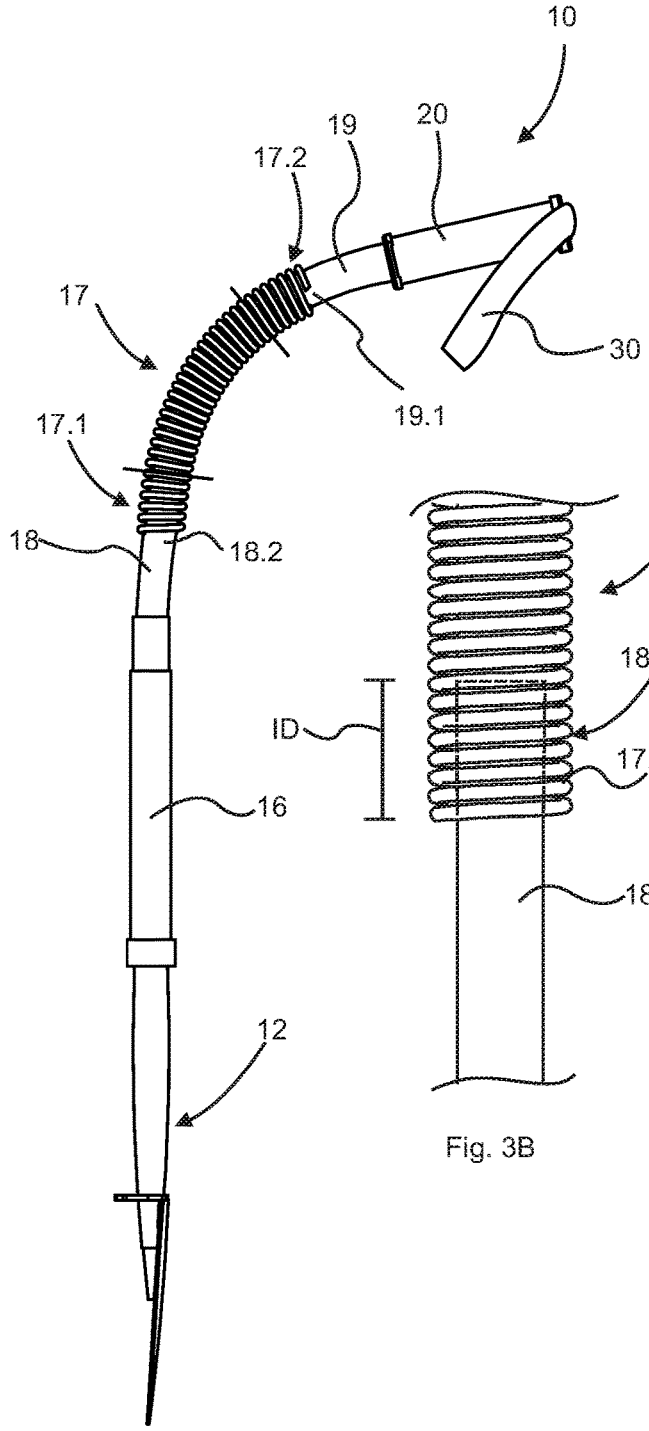
FIG. 3A is a side view of the tool handle apparatus according to select embodiments of the instant disclosure, with spring deflected or bent.
Figure 3B:
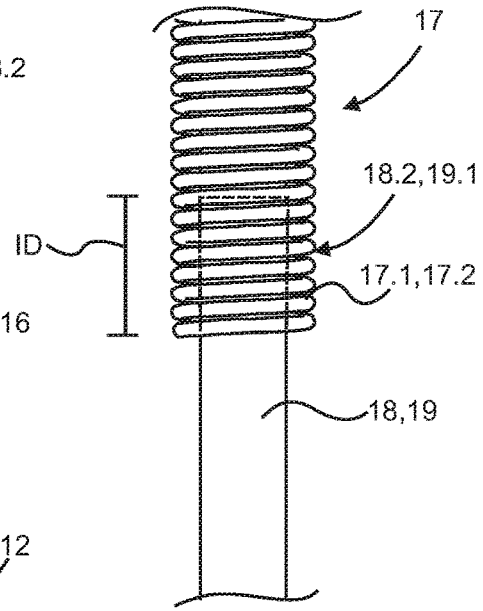
FIG. 3B is an exploded side view of the tool handle apparatus according to select embodiments of the instant disclosure, with shaft shown inserted into spring.
Figure 5:
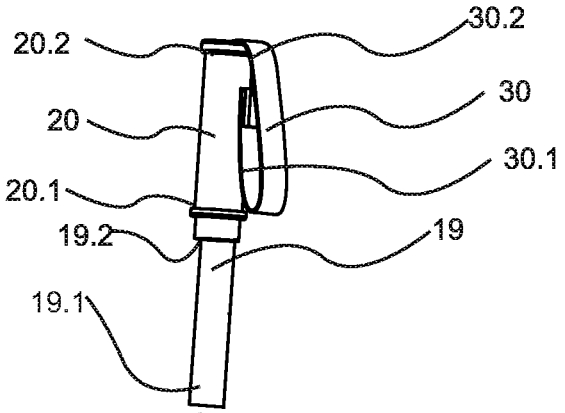
FIG. 5 is an exploded view of the tool handle apparatus according to select embodiments of the instant disclosure, showing handle extension and handle.
Figure 4:
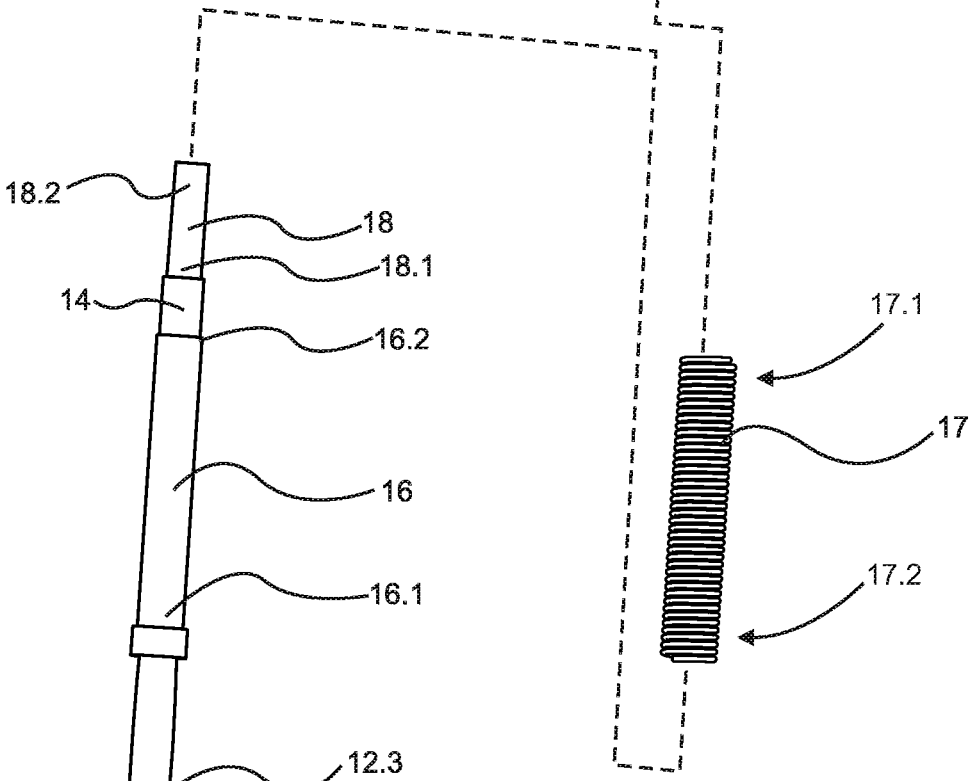
FIG. 4 is an exploded view of the tool handle apparatus according to select embodiments of the instant disclosure, showing biasing element.
Figure 6:
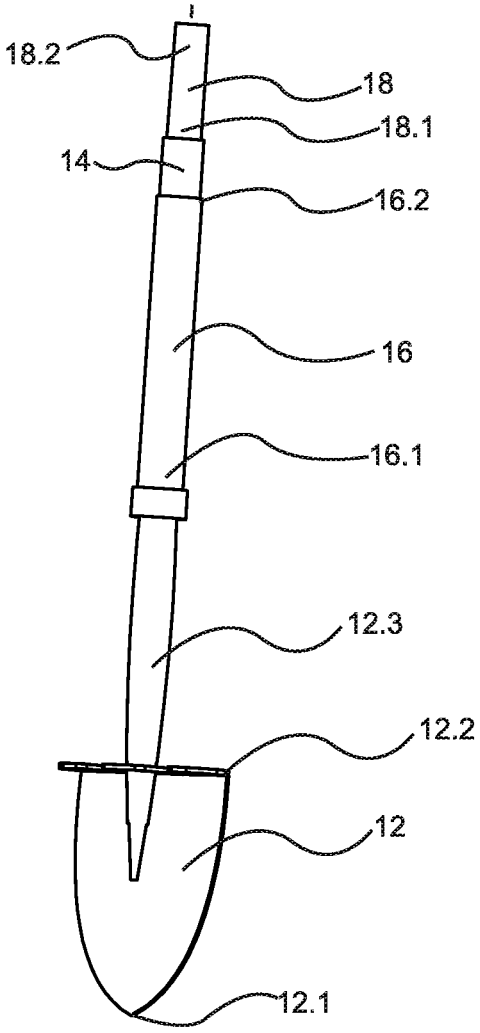
FIG. 6 is an exploded view of the tool handle apparatus according to select embodiments of the instant disclosure, showing work piece, grip, handle grip surface, spring extension.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1, 2, 3A, 3B, 4, 5, 6, 7 and 8 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-3A, 3B, 4-6, by way of example, and not limitation, there is illustrated an example embodiment of tool handle apparatus 10, according to this select embodiment. In this select embodiment, tool handle apparatus 10 may include work piece (12), such as spade 12. It is contemplated herein that work piece may include a shovel, rake, broom, pitch fork, hoe, ax, hammer and other yard, garden or hand tools. Work piece, such as spade 12 may include work piece edge 12.1, such as blade edge 12.1, foot step 12.2 to thrust work piece edge 12.1 into the dirt by foot force, and connector neck 12.3 to connect work piece 12, such as spade 12 to a handle. A first elongated member, such as grip 16 may include first grip end 16.1 and second grip end 16.2. First grip end 16.1 may be inserted therein or connected thereto connector neck 12.3 of work piece 12, such as spade 12 to connect first grip end 16.1 to connect neck 12.3 of work piece, such as spade 12. First elongated member, such as grip 16 may further include hand grip surface 14 that surrounds first elongated member, such as grip 16, to enable a user of tool handle apparatus 10 to securely grip first elongated member 16, such as grip 16.

A first or second elongated member, such as spring extension 18 may include first spring extension end 18.1 and second spring extension end 18.2. Second grip end 16.2 may be connected to first spring extension end 18.1 where for example, first spring extension end 18.1 may be inserted therein or connected thereto second grip end 16.2 to connect spring extension 18 thereto grip 16.

A biasing element, such as coil spring 17 may include first coil spring end 17.1 and second coil spring end 17.2. First coil spring end 17.1 may be connected to second spring extension end 18.2 where for example, second spring extension end 18.2 may be inserted therein or connected thereto first coil spring end 17.1 to connect spring extension 18 thereto coil spring 17. A test device utilizes a 60 kilogram power twister spring.

It is contemplated herein that first elongated member may include first grip end 16.1 and second grip end 16.2 positioned on work piece end of coil spring 17 or first coil spring end 17.1 of tool handle apparatus 10.

It is further contemplated herein that second elongated member may include first handle extension end 19.1 and second handle extension end 19.2 positioned opposite work piece end of coil spring 17 or second coil spring end 17.2 of tool handle apparatus 10.

A second or third elongated member, such as handle extension 19 may include first handle extension end 19.1 and second handle extension end 19.2. First handle extension end 19.1 may be connected to second coil spring end 17.2 where for example, first handle extension end 19.1 may be inserted therein or connected thereto second coil spring end 17.2 to connect handle extension 19 thereto coil spring 17.

A third elongated member, such as handle extension 19 may include first handle extension end 19.1 and second handle extension end 19.2. First handle extension end 19.1 may be connected to second coil spring end 17.2 where for example, first handle extension end 19.1 may be inserted therein or connected thereto second coil spring end 17.2 to connect handle extension 19 thereto coil spring 17.

A second or fourth elongated member, such as handle 20 may include first handle end 20.1 and second handle end 20.2. First handle end 20.1 may be connected to second handle extension end 19.2 where for example, second handle extension end 19.2 may be inserted therein or connected thereto first handle end 20.1 to connect handle 20 thereto handle extension 19.

A safety tether, such as wrist strap 30 may include first strap end 30.1 and second strap end 30.2. First strap end 30.1 and second strap end 30.2 may be affixed proximate second handle end 20.2 configured (forming) a loop where a user of tool handle apparatus 10 may secure tool handle apparatus 10 to user's U wrist W to prevent tool handle apparatus 10 from leaving the hand control of user U when catapulting, sling, spreading, or emptying shovel Work piece, such as spade 12.

It is contemplated herein that transitions between parts may be affixed or removeably affixed by coupling, crimp, adhesive, bolt, washer, and nut, pin, rivet or other known way to make a connection.

Referring again to FIG. 3A, by way of example, and not limitation, there is illustrated an example embodiment of tool handle apparatus 10, and more specifically a view of handle 20 positioned perpendicular to grip 16 with coil spring 17 bent or flexed in a radial arc therebetween.

Referring again to FIG. 3B, by way of example, and not limitation, there is illustrated an example embodiment of tool handle apparatus 10, and more specifically a view of second spring extension end 18.2 of spring extension 18 or first handle extension end 19.1 of handle extension 19 inserted partially therein first coil spring end 17.1 and second coil spring end 17.2 of coil spring 17, respectively to enable bending, flexing of tool handle apparatus 10 to catapult, sling, spread, disperse, or empty shovel, rake, broom, pitch fork, or other yard, garden tool or hand tools contents further or to swing an ax or hammer with accelerated whip and impact.

Referring again to FIGS. 4-6, by way of example, and not limitation, there is illustrated an example embodiment of tool handle apparatus 10, and more specifically an exploded view of coil spring 17, handle 20 wrist strap 30, and spring extension 18, grip 16, work piece, such as spade 12 shown disassembled with dotted lines showing the order of assembly of the parts.

Moreover, first coil spring end 17.1 may be connected to second spring extension end 18.2 where for example, second spring extension end 18.2 may be inserted therein, an insertion distance ID, first coil spring end 17.1 to connect spring extension 18 thereto coil spring 17 and first handle extension end 19.1 may be connected to second coil spring end 17.2 where for example, first handle extension end 19.1 may be inserted therein, an insertion distance ID, second coil spring end 17.2 to connect handle extension 19 thereto coil spring 17.

Furthermore, first strap end 30.1 and second strap end 30.2 may be affixed proximate second handle end 20.2 configured (forming) a loop where a user of tool handle apparatus 10 may secure tool handle apparatus 10 to user's U wrist W to prevent tool handle apparatus 10 from leaving the hand control of user U when catapulting, sling, spreading, or emptying shovel work piece, such as spade 12.

Figure 7:
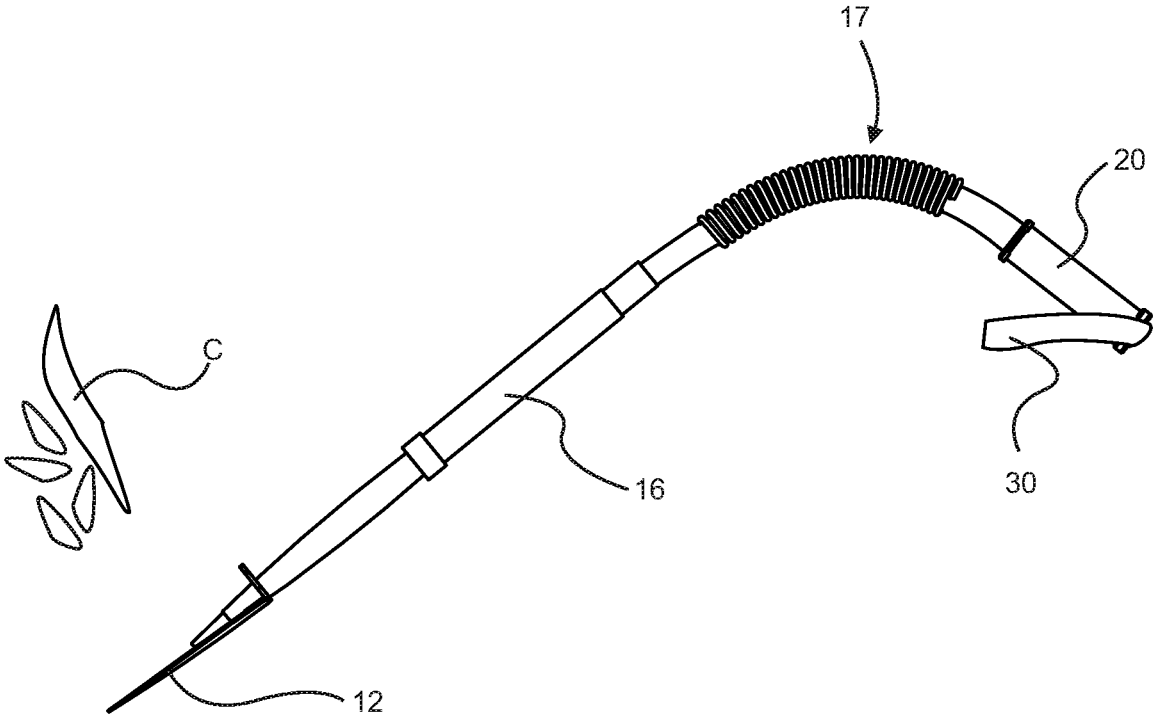
FIG. 7 is a perspective view of the tool handle apparatus according to select embodiments of the instant disclosure shown in use catapulting, slinging or spreading content therefrom.

Referring now to FIG. 7, by way of example, and not limitation, there is illustrated an example embodiment of tool handle apparatus 10, according to this select embodiment. In this select embodiment, tool handle apparatus 10 is shown in use by a user. Moreover, user U may bend or whip handle 20 to a position approximately perpendicular to grip 16 with coil spring 17 bent or flexed in a radial arc therebetween where bending, flexing of tool handle apparatus 10 and release results in a catapult, sling, spread, empty of contents C (dirt, debris, dust, manure, snow, sand, compost, leaves, pine straw, and the like) positioned on shovel, rake, broom, pitch fork, or other yard, garden or hand tools or swing of same or an ax or hammer with accelerated whip and impact.

Figure 8:
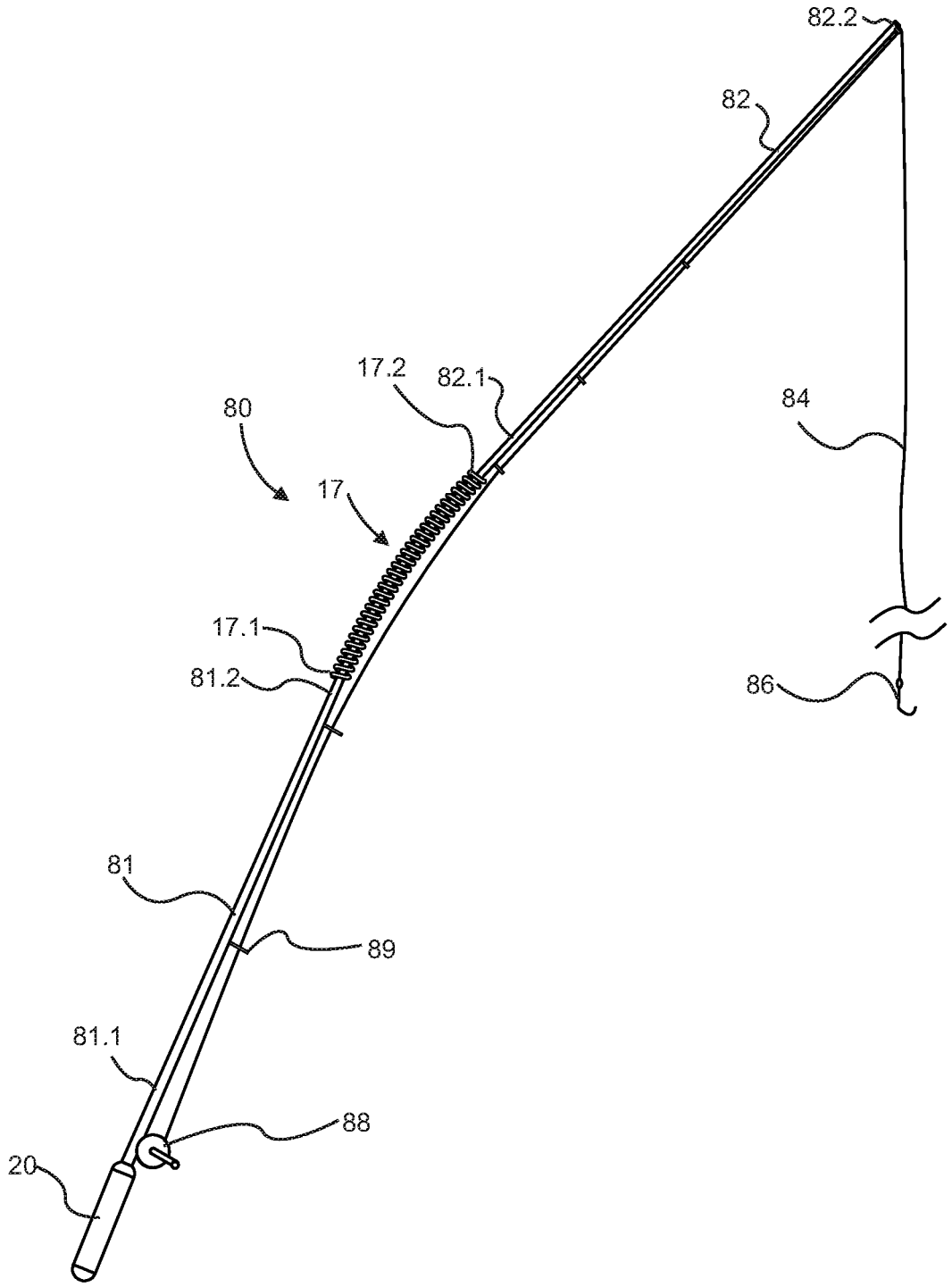
FIG. 8 is a perspective view of the tool handle apparatus according to select embodiments of the instant disclosure shown in use casting or whipping a fishing pole.

Referring now to FIG. 8, by way of example, and not limitation, there is illustrated an example embodiment of fishing pole apparatus 80, according to this select embodiment. In this select embodiment, fishing pole apparatus 80 may include handle 20 connected to a first elongated pole member, such as handle section 81 having first handle section end 81.1 and second handle section end 81.2. First handle section end 80.1 may connected thereto handle 20.

A biasing element, such as coil spring 17 may include first coil spring end 17.1 and second coil spring end 17.2. First coil spring end 17.1 may be connected to second handle section end 81.2 where for example, second handle section end 81.2 may be inserted therein or connected thereto first coil spring end 17.1 to connect handle section 81 thereto coil spring 17.

A second elongated pole member, such as spring extension member 82 may include first spring extension end 82.1 and second spring extension end 82.2. Second coil spring end 17.2 may be connected to first spring extension end 82.1 where for example, first spring extension end 82.1 may be inserted therein or connected thereto second coil spring end 17.2.

Moreover, fishing pole apparatus 80 may include reel 88, fishing line 84, fed through pole loops 89, and a fishing lure, such as fish hook/lure 86. Furthermore, user U may bend or whip handle 20 to a position approximately perpendicular to spring extension member 82 with coil spring 17 bent or flexed in a radial arc therebetween where bending, flexing of fishing pole apparatus 80 and release results in a catapult, sling, accelerated whip of fishing pole apparatus 80.

It is contemplated herein that tool handle apparatus 10 and fishing pole apparatus 80 may be constructed of metal, wood, rigid plastic, nylon, or the like and of different dimensions. This and other materials herein may be constructed of metal, steel, aluminum, alloy, or plastic or more specifically high density polyethylene or similar high tensile or strengthened materials, as these material offers a variety of forms and shapes and provide strength; however, other suitable materials or the like, can be utilized, provided such material has sufficient strength and/or durability as would meet the purpose described herein to enable tool handle apparatus 10 to be used as a work piece, long handle, and allow bending, flexing of tool handle apparatus 10 resulting in a catapult, sling, spread, of contents or to enable fishing pole apparatus 80 to catapult, sling, accelerated whip of fishing pole apparatus 80.

It is understood herein that various changes in the material used, shape, size, arrangement of parts, and parts are connected with adhesive, bolts, pins, rivets, screws or similar fasteners without departing from the spirit of the scope of the claims herein.

It is further understood herein that the parts and elements of this disclosure may be located or position elsewhere based on one of ordinary skill in the art without deviating from the present disclosure.

Figure 9:
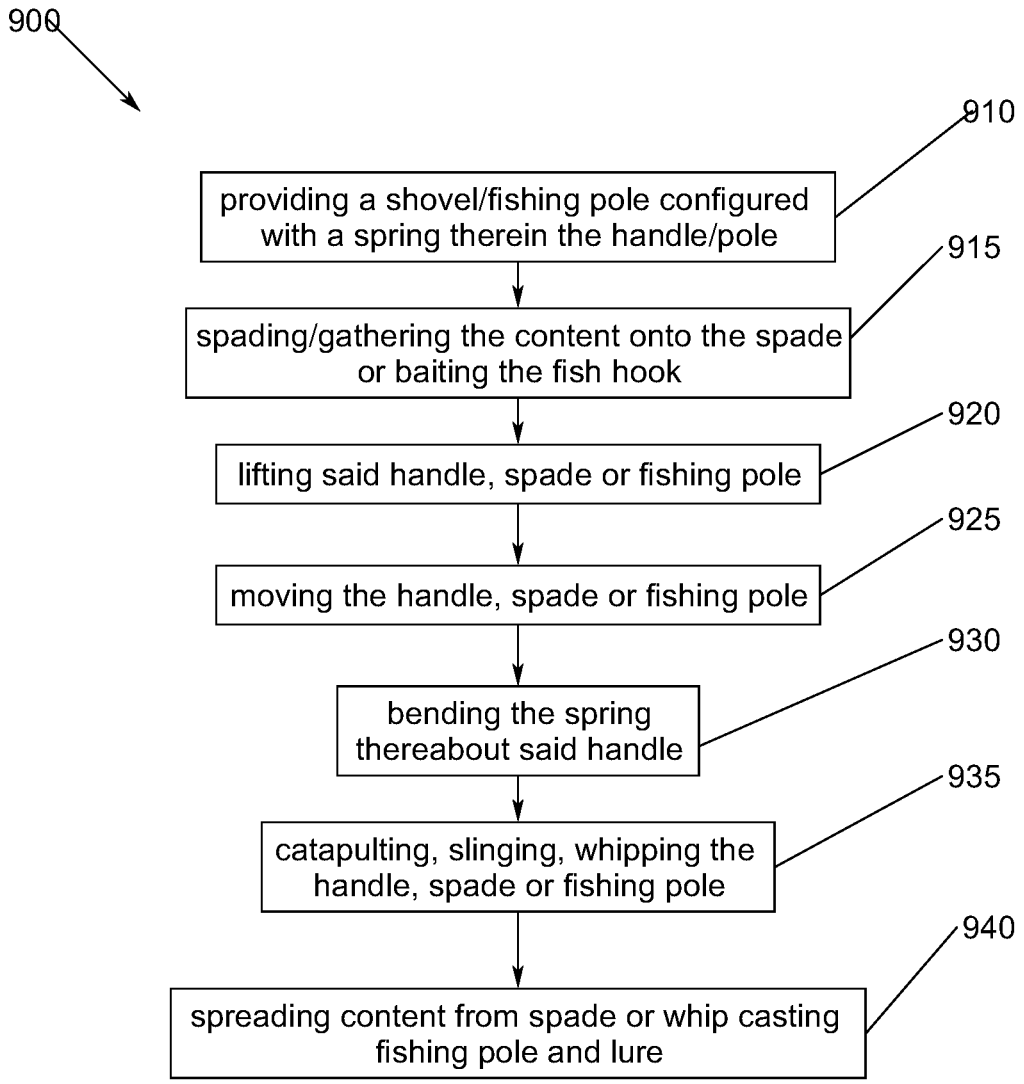
FIG. 9 is a flow diagram depicting how tool handle apparatus of FIGS. 1-7 is preferably utilized.

Referring now to FIG. 9, there is illustrated a flow diagram 900 of a method of bending, flexing of tool handle apparatus 10 results in a catapult, sling, spread, of contents. In block or step 910, providing tool handle apparatus 10 having at least work piece, handle extension 19, coil spring 17, and grip 16 or fishing pole apparatus 80 having handle 20, elongated pole member, such as handle section 81, coil spring 17, reel 88, fishing line 84, fed through pole loops 89 as described above in FIGS. 1-3A, 3B, 4-8. In block or step 915, gathering content C on work piece, such as spade 12 or baiting and fish hook 86. In block or step 920, lifting tool handle apparatus 10 having at least work piece, handle extension 19, coil spring 17, and grip 16 or fishing pole apparatus 80 having handle 20 or content C on work piece, such as spade 12 or baiting and fish hook 86. In block or step 925, moving tool handle apparatus 10 having at least work piece, handle extension 19, coil spring 17, and grip 16 or fishing pole apparatus 80 having handle 20 or content C on work piece, such as spade 12 or baiting and fish hook 86. In block or step 930, bending spring 17 thereabout grip 16, spring extension 18, or handle section 81 relative to handle 20. In block or step 935, catapulting, slinging, swinging handle 20, grip 16, spring extension 18, or handle section 81 relative to handle 20. In block or step 940, spreading, dispersing, emptying of contents C from work piece, such as spade 12 or catapulting, slinging contents C from work piece, such as spade 12 accelerated whipping (whip casting) of fishing pole apparatus 80 and fish hook/lure 86.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein but is limited only by the following claims.

The invention claimed is:

1. A tool handle apparatus for lifting and scattering content, said apparatus comprising:

a work piece having a connector neck;

a first elongated member having a first grip end and a second grip end, said first grip end connected to said connector neck;

a coil spring having a first coil spring end and a second coil spring end, said first coil spring end connected to said second grip end;

a second elongated member having a first spring extension end and a second spring extension end, said first spring extension end connected to said second coil spring end; and a handle, said handle connected to said second spring extension end;

wherein said first elongated member and said second elongated member are spaced apart from one another and said second elongated member is connected to said first elongated member only via said coil spring; and wherein said second elongated member is positioned perpendicular to said first elongated member when said coil spring is bent in a radial arc therebetween.

2. The apparatus of claim 1, further comprising a wrist strap affixed to said handle.

3. The apparatus of claim 1, further comprising a hand grip surface surrounding said first elongated member.

4. The apparatus of claim 1, wherein said work piece is a shovel.

5. The apparatus of claim 1, wherein said work piece is a rake.

6. The apparatus of claim 1, wherein said work piece is a broom.

7. The apparatus of claim 1, wherein said work piece is a pitch fork.

8. The apparatus of claim 1, wherein said work piece is a garden tool.

9. The apparatus of claim 1, wherein said work piece is a hand tool.

10. The apparatus of claim 1, wherein said work piece is an ax.

11. The apparatus of claim 1, wherein said work piece is a hammer.

12. A method of dispersing content, said method comprising the steps of;

providing a tool handle configured as a work piece having a connector neck, a first elongated member having a first grip end and a second grip end, said first grip end connected to said connector neck, a coil spring having a first coil spring end and a second coil spring end, said first coil spring end connected to said second grip end, a second elongated member having a first spring extension end and a second spring extension end, said first spring extension end connected to said second coil spring end, and a handle, said handle connected to said second spring extension end; wherein said first elongated member and said second elongated member are spaced apart from one another and said second elongated member is connected to said first elongated member only via said coil spring; and wherein said second elongated member is positioned perpendicular to said first elongated member when said coil spring is bent in a radial arc therebetween;

gathering content on said work piece;

bending said coil spring relative to said handle; and spreading the content by discharging the content from said work piece.

13. The method of claim 12, further comprising the step of lifting said first elongated member.

14. The method of claim 12, wherein said work piece is a shovel.

15. The method of claim 12, wherein said work piece is a rake.

16. The method of claim 12, wherein said work piece is a broom.

17. The method of claim 12, wherein said work piece is a pitch fork.

18. The method of claim 12, wherein said work piece is a garden tool.

19. The method of claim 12, wherein said work piece is a hand tool.

20. The method of claim 12, wherein said work piece is an ax.

21. The method of claim 12, wherein said work piece is a hammer.

* * * * *